US009671093B2

(12) United States Patent
Liao et al.

(10) Patent No.: US 9,671,093 B2
(45) Date of Patent: Jun. 6, 2017

(54) HOLDER FOR HOLDING A CARRIER, A LIGHTING MODULE, A LUMINAIRE AND A METHOD OF MANUFACTURING A HOLDER FOR A LIGHTING MODULE

(71) Applicant: PHILIPS LIGHTING HOLDING B.V., Eindhoven (NL)

(72) Inventors: Huaizhou Liao, Shanghai (CN); Qin Li, Shanghai (CN); Peter Hubertus Franciscus Deurenberg, s-Hertogenbosch (NL); Feng He, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/437,053

(22) PCT Filed: Jul. 17, 2014

(86) PCT No.: PCT/IB2014/063177

§ 371 (c)(1),
(2) Date: Apr. 20, 2015

(87) PCT Pub. No.: WO2015/028902

PCT Pub. Date: Mar. 5, 2015

(65) Prior Publication Data

US 2016/0195249 A1 Jul. 7, 2016

(30) Foreign Application Priority Data

Aug. 28, 2013 (WO) ..... PCT/CN2013/001020
Nov. 23, 2013 (EP) ..... 13194174

(51) Int. Cl.
*F21V 19/00* (2006.01)
*F21V 17/10* (2006.01)
(Continued)

(52) U.S. Cl.
CPC ..... *F21V 19/004* (2013.01); *F21V 17/10* (2013.01); *F21Y 2115/10* (2016.08); *F21Y 2115/30* (2016.08)

(58) Field of Classification Search
CPC ..... F21V 19/004; F21V 17/10; F21V 17/16; F21V 15/04; F21V 21/088; F21Y 2101/025
See application file for complete search history.

(56) References Cited

U.S. PATENT DOCUMENTS

2008/0130275 A1 6/2008 Higley et al.
2012/0113642 A1* 5/2012 Catalano ..... F21S 8/02 362/249.02
2012/0281410 A1* 11/2012 Wong ..... F21S 8/026 362/249.02

FOREIGN PATENT DOCUMENTS

EP 2423570 A2 2/2012
EP 2570721 A1 3/2013
WO 2012138596 A1 10/2012

* cited by examiner

*Primary Examiner* — Julie Bannan

(57) ABSTRACT

A holder (210) for holding a carrier (240) comprising solid state light emitters (242), a lighting module, a luminaire and a method of manufacturing a holder for a lighting module are provided. The holder (210) comprises a light exit window (214), a fastening element (212), a contact surface (226) and at least two hooks (220). The contact surface provides a stop position with which the carrier is in contact when the carrier is assembled in the holder. The at least two hooks are moveable between a clamping position and a sidewards position. When the holder is assembled to the carrier, i) and when said hooks are in the clamping position, said hooks are arranged for clamping the carrier between said hooks and the contact surface, and ii) when the holder is fastened to the mounting surface of the another object,
(Continued)

said hooks are in the sidewards position, the sidewards positions is a position away from the carrier.

14 Claims, 4 Drawing Sheets

(51) Int. Cl.
*F21Y 115/30* (2016.01)
*F21Y 115/10* (2016.01)

HOLDER FOR HOLDING A CARRIER, A LIGHTING MODULE, A LUMINAIRE AND A METHOD OF MANUFACTURING A HOLDER FOR A LIGHTING MODULE

CROSS-REFERENCE TO PRIOR APPLICATIONS

This application is the U.S. National Phase application under 35 U.S.C. §371 of International Application No. PCT/IB2014/063177, filed on Jul. 17, 2014, which claims the benefit of European Patent Application No. 13194174.2, filed on Nov. 23, 2013 and of International Application No. PCT/CN2013/001020, filed on Aug. 28, 2013. These applications are hereby incorporated by reference herein.

FIELD OF THE INVENTION

The invention relates to lighting modules which comprise solid state light emitters on a carrier held by a holder. The lighting modules are often provided with a cover and/or optical components and comprise means to connect the lighting modules to other components such that they can be easily integrated in, for example, luminaires.

The invention further relates to a lighting module and a method of manufacturing a holder for a lighting module.

BACKGROUND OF THE INVENTION

A light emitter manufacturer may integrated manufactured solid state light emitters, such as Light Emitting Diodes (LEDs), in a semi-finished lighting module which is ready for integration in a luminaire. Different levels of integration are defined. A level 2 module at least comprises solid state light emitters on a printed circuit board (PCB) and comprises a driving circuit. The driving circuit may be provided on a separate PCB. The PCB with the solid state light emitters often acts as an interface to a heat sink. Level 2 plus lighting modules further comprise a holder for holding and/or enclosing the PCB with solid state light emitters and the holder comprises holes for mounting the level 2 plus module to other surfaces/modules (for example, to a heat sink of a luminaire). A user, or a luminaire manufacturer may use screws for mounting the level 2 plus lighting module. The holder protects the PCB with solid state light emitters such that a user, when the lighting module is assembled in a luminaire, cannot touch the PCB and/or the solid state light emitters. The holder may comprise additional optical elements through which, in use, light is emitted into the ambient of the level 2 plus module.

In general the manufacturer of the (level 2 plus) lighting module assembles the lighting module as far as possible such that the PCB with solid state light emitter is at least mounted to the holder to allow a customer to easily screw the assembled lighting module to an appropriate surface of a luminaire.

Published patent application EP2423570A2 discloses an embodiment of such a lighting module. The lighting module includes a light engine having a printed circuit board and an array of light emitting diodes coupled to the printed circuit board. The printed circuit board has a power connector interface defining a separable interface for coupling with a power connector of the light module. A base ring holds the light engine and has side walls defining a cavity. The side walls have a securing feature. The base ring also comprises holes for receiving screws for fastening the lighting module to another component. An optical component is received in the cavity and is positioned to receive light from the LEDs. The optical component has a predetermined lighting characteristic and emits the light generated by the LEDs in accordance with the predetermined lighting characteristic. A top cover is coupled to the base ring and has a securing feature engaging the securing feature of the base ring to couple the top cover to the base ring. A compression ring is positioned between the base ring and the optical component. The compression ring is compressed between the base ring and the optical component when the top cover is coupled to the base ring.

The lighting module of the above cited patent application has holes in the base ring for receiving screws to attach the module to a component (such as a heat sink of a luminaire). These holes are, when the lighting module is assembled, covered by at least the optical component. Thus, when the manufacturer of the lighting module delivers the assembled lighting module to a customer, the customer has to remove the top cover and the optical component to access the holes. Alternatively, the manufacturer may deliver half-assembled lighting modules and the customer has to assemble the lighting module himself. Both options are inconvenient for a customer.

SUMMARY OF THE INVENTION

It is an object of the invention to provide a holder for a printed circuit board (PCB) with solid state light emitters which reliable holds the PCB and which easily allows a user to fasten an assembled lighting module comprising the PCB and the holder.

A first aspect of the disclosure provides a holder for a lighting module. A second aspect provides a lighting module. A third aspect provides a luminaire. A fourth aspect provides a method of manufacturing a holder for a lighting module. Advantageous embodiments are defined in the dependent claims.

A holder in accordance with the first aspect of the invention comprises a light exit window, a fastening element, a contact surface and at least two hooks. The holder is suitable for holding a carrier which comprises solid state light emitters. The light exit window allows a transmission of light into an ambient of the holder wherein the light is emitted, in use, by the solid state light emitters of the carrier. The fastening element is for receiving a fastening means for fastening the holder to a surface of another object. The fastening element is accessible from the outside of the holder when the holder holds the carrier and when the holder with carrier is fastened to the mounting surface. The contact surface provides a stop position with which the carrier is in contact when the carrier is assembled in the holder and which holds the carrier between the contract surface and the surface of the another object when the holder is fastened to the surface of the another object. The at least two hooks are moveable between a clamping position and a sidewards position. When the holder is assembled to the carrier and when said hooks are in the clamping position, said hooks are arranged for clamping the carrier between the hooks and the contact surface. When the holder is assembled to the carrier and when the holder is fastened to the surface of the another objects, said hooks are arranged to be in the sidewards position, the sidewards positions is a position away from the carrier.

The holder is configured for holding a carrier which comprises solid state light emitters. The carrier may be a printed circuit board, but may also be another type of carrier (such as a substrate of glass or a synthetic material) on which wires and solid state light emitters are provided. The carrier may be flat, but may also be slightly curved. The holder is in particular configured to hold the carrier when the holder is fastened to a mounting surface of another object. Such another object may be a component of a luminaire and the mounting surface of the another object may provide an interface to a heat sink. When the holder is assembled to the carrier, in other words, when the holder holds the carrier, and when the solid state light emitters of the carrier emit light, the emitted light is transmitted through the light exit window into the ambient of the holder.

When the holder is assembled to the carrier, thus, when the holder holds the carrier, the carrier is in contact with the contact surface of the holder. As will be discussed hereinafter, the carrier may be clamped in the holder and/or the carrier may be provided in between the contact surface and the mounting surface of the another object. When the carrier is clamped in or hold by the holder, the carrier may receive a force into the direction of the light exit window and the contact surface defines a position at which the carrier is stopped (a surface to which surface the carrier may be pressed) when the carrier receives such a force. More in particular, when the holder is fastened with fastening means to the mounting surface, a portion of the carrier is in between the contact surface and the surface of the another object.

The holder also comprises at least two hooks. The hooks have, in particular, an important role in the assembling of the holder to the carrier. When the holder is assembled to the carrier, the at least two hooks are in the clamping positions and in this position the at least two hooks are arranged for clamping the carrier between the hooks and the contact surface. It is to be noted that this configuration, wherein the at least two hooks clamp the carrier to the contact surface, relates to a configuration wherein the holder is not fastened to the mounting surface of the another object. When the holder, which holds the carrier, is fastened to the mounting surface of the another object, the hooks are in a sidewards position, which means that the hooks are arranged in a position that is away from the carrier. In other words, the hooks to not touch the carrier and are in a position where they cannot be in between the carrier and the mounting surface. The hooks are moveable between the clamping position and the sidewards positions.

The above discussed holder has hooks which clamp the carrier in a position against the contact surface such that the carrier with solid state light emitters is secured within the holder. It is very convenient for the manufacturer and the customer that the holder can be assembled to the carrier without the need to fasten the holder to the mounting surface. This implies that the manufacturer is able to sell the holder with carrier as a single component. Subsequently, when the customer fastens the holder with carrier to the mounting surface, the hooks are in the sidewards position and in the sidewards position the carrier is held in between the mounting surface and the contact surface and no parts of the hooks are in between the carrier and the mounting surface. Thus, the carrier can make good contact to the mounting surface, for example, for forming a good thermal coupling to the mounting surface. It is not required for the customer to remove the hooks form the holder or it is not required for a customer to open the complete holder in order to remove the hooks or to provide fastening means. Thus, the fact that the hooks are, when the holder is fastened to the mounting surface, in the sidewards position is conveniently for the customer.

It is to be noted that at every location where the term "customer" is used, or where the term "user" is used, the term "manufacturer of a luminaire" may be read as well, because, in many practical situations the manufacturer of the luminaire buys the holder with the carrier and fastens the holder with carrier to the mounting surface of the another object.

The fastening element is provided at the outside of the holder when the holder holds the carrier and the holder is fastened to the mounting surface. This means that the user does not have to open the holder or remove elements from the holder in order to access the fastening element. In an example, the fastening opening is a recess in the outer surface of the holder and the recess for receiving a screw or a nail for fastening the holder to the mounting surface. In another example, the fastening opening is a protrusion which extends from the holder and which is in contact with the mounting surface of the another object when the holder is pressed against the mounting surface, the protrusion may provide an opening for receiving a screw or a nail for fastening the holder to the mounting surface.

The above described holder (and carrier) are not limited to any particular type of solid state light emitter. In a specific embodiment, the solid state light emitters are laser diodes, or Light Emitting Diodes (LEDs), or Organic Light Emitting Diodes (OLEDs). The solid state emitters may also comprise combinations of the different types of solid state light emitters.

As discussed above, the mounting surface of the another object may provide an interface to an heat sink or may be a surface of a heat sink. For example, when the mounting surface is a metal surface, it is well capable of receiving heat and transporting it away from the holder with the carrier comprising the solid state light emitters. In many practical embodiments of carriers comprising solid state light emitters, at a first side of the carrier are provided the solid state light emitters, and measures are taken to transport the heat of the slid state light emitters towards a second side of the carrier (which is opposite the first side of the carrier). Therefore, in many practical embodiments of a holder with a carrier, the first side of the carrier faces the light exit window such that the light emitted by the solid state light emitter can be transmitted through the light exit window into the ambient of the holder, and the second side of the carrier is present at a side of the holder which is opposite the light exit window and which is in contact with the mounting surface when the holder with carrier is fastened to the mounting surface. Thus, in many practical embodiments, the first side of the carrier is partially in contact with the contact surface. In many practical embodiments, a back side of the holder, which is opposite a front side of the holder (which is the side which comprises the light exit window), is parallel to the second surface of the carrier when the holder holds the carrier.

The carrier comprises the solid state light emitters. More in particular, the carrier carries the solid state light emitters. A specific embodiment of the carrier comprising the solid state light emitters is a printed circuit board. Other embodiments are possible as well, such as, for example, a carrier of glass on which metal tracks and solid state light emitters are provided.

In the sidewards position, the hooks are in a position away from the carrier, which means that they are not any more in contact with the carrier and there is at least a small distance between the carrier and the hooks. In an embodiment, the hook are sidewards of the carrier when they are in the sidewards position. Sidewards of the carrier means that, seen in a lateral direction (which is a direction parallel to the carrier) the sidewards position is a position away from the carrier, which means, a position further away from the center of the carrier in comparison to the clamping position.

Optionally, the position of the contact surface and said hooks in the sidewards position are arranged for allowing a contact between the carrier and the mounting surface of the another object. A good contact between the carrier and the mounting surface creates a relatively good thermal interface such that heat generated in the solid state light emitters may easily flow towards a heat sink that is thermally coupled to the mounting surface. In an embodiment, when the carrier has a first surface carrying the solid state light emitters and has a second surface opposite the first surface, the whole second surface is configured to be brought in contact with the mounting surface. In specific other embodiment, the second surface of the carrier may have protruding element which are thermal conductive and the protruding elements are brought in contact with the mounting surface.

Optionally, the holder has a front panel which is a panel of the holder which comprises the light exit window. Said hooks comprise an arm which protrudes away from the front panel. Said arms have a base end at a position where the arms are coupled to the front panel, and said arms have a free end which is opposite the base end. Said hooks comprise a clip for engaging with a side of the carrier in the clamping position of said hooks. Said clips are for clamping the carrier between said clips and the contact surface and they are arranged at the free end of said arms and extend from the free end substantially into a direction of a central point of the carrier when the holder holds the carrier.

Manufacturing arms with clips is relatively easy and, thus, may result in a relatively low price for the holders. Furthermore, the clips on the arms may allow clicking the carriers into the holder which is a relatively easy step to perform thereby creating an efficient, and thus relatively cheap, assembling step.

It is to be noted that the arms have not necessary a bar shape, or a rod shape. The term "arm" is used because in a cross-sectional shape the arms have a rod-like or bar-like shape. Thus, the arms also have the shape of a wall and the walls may have the shape of a portion of a cylinder. A basic character of the arms is that they are in one direction relatively thin.

The front panel of the holder does not necessary exists of a solid material. The light exit window may be an opening and in such a situation the front panel is partly formed by a virtual plane defined by the opening. In a practical embodiment, the front panel of the holder is a side of the (assembled) holder which is opposite the mounting surface when the holder with carrier is fastened to the mounting surface of the another object.

Optionally, the holder comprises a contact protrusion which extends away from the front panel. A first end of the contact protrusion is opposite the second end of the contact protrusion, the first end comprises the contact surface and the second end is coupled to the front panel. It is relatively easy to manufacture at relatively low costs such contact protrusions. A protrusion does also not cost much material. In an embodiment, a plurality of contact protrusions are provided each having a first end and a second end. When a plurality of contact protrusions is provided, the contact surface is formed by the first ends of the contact protrusions. When several contact protrusions are used to bring a surface of the carrier in contact with the holder, space between the contact protrusions may allow the circulation of air, which is advantageous for transporting heat away from the solid state light emitters. The contact protrusion may have any shape which protrudes away from the front panels, such as a bar shape, rod shape, pyramid shape, and also a shape of a wall or a cylinder.

Optionally, said hooks are arranged to receive a force from the mounting surface of the another object when the holder is pressed against the mounting surface. The hooks are arranged to receive the force such that the reception of the force results in the moving of the hooks from the clamping position to the sidewards position. Thus, the moving of the hooks to the sidewards position is performed automatically when the holder is pressed against the mounting surface, which is, for example, the case then the holder is fastened to the mounting surface. Thus, the user does not have to intervene and the user does not have to move the hooks to the sidewards position. Thus, the buyer of the holder in which the carrier is provided is able to fasten the holder to the mounting surface by only providing the fastening means and when the holder is fastened, the hooks move and the carrier is capable of making a good contact to the mounting surface.

Optionally, when the hooks comprise, as discussed above, an arm with an clip, and when the hooks are arranged to receive the force, as discussed above, the hooks comprise an anchor bar that is provided at the free end of the arm. The anchor bars extend away from the free end in a direction away from the clips. The anchor bars are arranged to at least partially receive the force from the mounting surface of the another object when the holder is assembled to the carrier and when the holder is pressed to the mounting surface. Thus, the anchor bars are large enough and strong enough to receive the force such that when the force is received, the hooks move at least partially to the sidewards position. Anchor bars are, like arms and clips, easy to manufacture and not much material is needed to manufacture such anchor bars. The anchor bars are thus a cost effect means for receiving the force and moving the hooks at least partially to the sidewards position. It is to be noted that it is not required that the holder with carrier is fastened to the surface such that the anchor bars receive the force. In an embodiment, ends of anchor bars of the hooks slightly protrude out of the holder with carrier and when the holder with carrier is brought in contact with the mounting surface, the anchor bars first touch the mounting surface for receiving the force. In particular, when the holder with carrier is brought in contact with the mounting surface and the user pushes more to the holder with carrier (towards the mounting surface), the anchor bars receive an even larger force resulting in the movement of the hooks to the sidewards position. It is to be noted that, in an embodiment, the clips of the hooks may be arranged to also partially receive the force for, for example, completing the move of the hooks from the clamping position to the sidewards position.

Optionally, when the holder comprises arms, the arms of the hooks are slightly resilient for allowing a flexing from the clamping position to the sidewards position. The flexing may be initiated by the above discussed force that is received by, for example, the anchor bars. When such a force is not anymore received, the arms may flex back to their clamping position. It is relatively easy and cost effective to manufacture arms which are slightly resilient. For example, it is possible to manufacture an arm of a slightly flexible synthetic material which is relatively thin and has automatically a slightly resilient character.

Optionally, the arms are subdivided in a first portion and a second portion. The first portion is coupled to the front panel and the first portion is a portion of the arm at the based end of the arm. The second portion is consequently the other part of the arm which comprises the free end as well. When the hooks are in the camping position: i) first angles between the front panel and the first portions of the arms are in the range from 45 degrees to 80 degrees; the first angles are measured at a side of the arms that is facing away from a center of the carrier when the holder holds the carrier; ii) the second portions are arranged substantially perpendicular to the front panel and iii) second angles between the anchor bars and the second portions of the arms are within a range from 95 degrees to 120 degrees; the second angles are measure at a side of the arms that is facing away from the clips. It has been proven that hooks which have a shape according to this optional embodiment are effective and efficient for clamping the carrier in between the clips and the contact surface and for flexing towards the sidewards position such that the carrier can make a good contact with the mounting surface.

Optionally, the clips of the arms have a clipping surface for contacting the carrier when the holder is assembled to the carrier and when the holder is not fastened to the mounting surface. The clipping surfaces of the clips are arranged substantially perpendicular to the second portions of the arms.

Optionally, an outer surface of the holder has a substantially circuit cross-sectional shape seen in a plane that is substantially parallel to the light exit window. In another embodiment, the light exit window has a substantially circular shape. It is to be noted that the shape of the holder and/or light exit window is not limited to circular shapes only. In an embodiment, the shapes may be rectangular, square or elliptical. For particular applications of the holder particular shapes may be more appropriate than other shapes.

According to a second aspect, a lighting module is provide which comprises a holder according to any one of the above discussed embodiments, and which comprises a carrier comprising solid state light emitters. The holder holds the carrier.

Optionally, when the lighting module is not fastened to a mounting surface of another object, the carrier is clamped between the contact surface and the at least two hooks of the holder.

According to a fourth aspect of the invention, a luminaire is provided which comprises a holder according to the first aspect or comprises a lighting module according to the second aspect.

According to a fourth aspect, a method of manufacturing a holder for a lighting module is provided. The holder is for holding a carrier that comprises solid state light emitters. The method comprises the step of forming a holder from a synthetic material. The step of forming a holder at least comprises i) forming a light exit window for allowing the transmission of light into an ambient of the holder, the light being emitted, in use, by the solid state light emitters provided on the carrier, ii) forming a fastening element for receiving a fastening means for fastening the holder to a mounting surface of another object, iii) providing a contact surface for providing a stop position with which the carrier is in contact when the carrier is assembled in the holder and for holding the carrier between the contact surface and the mounting surface of the another object when the holder is fastened to the mounting surface of the another object, iv) forming at least two hooks being arranged for clamping the carrier to the contact surface when the holder is assembled to the carrier and being arranged for moving away from the carrier when the holder comprising the carrier is fastened to the mounting surface of the another object.

The lighting module and the method according to the second aspect and third aspect provide the same benefits as the holder according to the first aspect of the invention and have similar embodiments with similar effects as the corresponding embodiments of the system.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the holder, the lighting module, and/or the method, which correspond to the described modifications and variations of the holder, can be carried out by a person skilled in the art on the basis of the present description.

Figure 1:
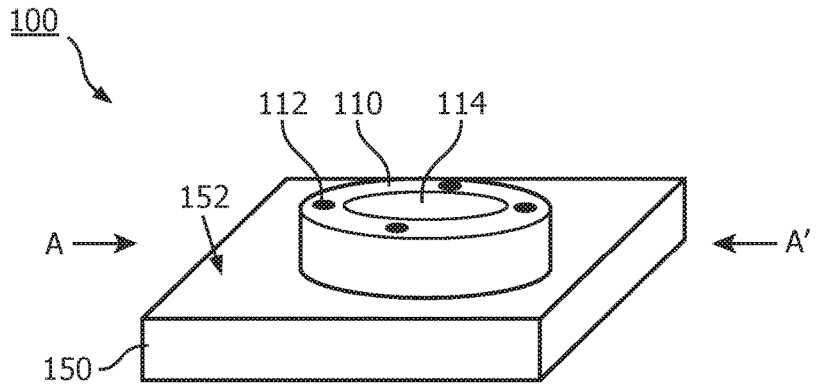
FIG. 1 schematically shows an embodiment level 2 lighting module that is assembled to a mounting surface of another object, FIG. 2 schematically shows a holder with a carrier in which hooks of the holder are in a clamping position, FIG. 3 schematically shows a holder with a carrier that is assembled to a mounting surface and in which the hooks of the holder are in the sidewards position, FIG. 4 schematically shows a cross-sectional view of another embodiment of a holder that is holding a printed circuit board, FIG. 5 schematically shows a detail of the cross-sectional view of FIG. 4 wherein the presented hook is in the clamping position, FIG. 6 schematically shows a cross-sectional view of the another embodiment of the holder when the holder is being fastened to another object, FIG. 7 schematically shows a detail of the cross-sectional view of FIG. 6 wherein the presented hook is in the sidewards position, FIG. 8 schematically shows an embodiment of a method of manufacturing a holder for a lighting module, and FIG. 9 schematically shows a luminaire.

It should be noted that items denoted by the same reference numerals in different Figures have the same structural features and the same functions, or are the same signals. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

FIG. 1 schematically shows an embodiment level 2 lighting module that is assembled to a mounting surface 152 of another object 150. The figure shows a portion of the another object 150 which comprises the mounting surface 152. A holder 110 of a level 2 lighting module is provided on the mounting surface 152. The holder 110 has a light exit window 114 and comprises, for example, holes 112 in which fastening means are provided which fasten the holder 110 to the mounting surface 152. The fastening means are, for example, screws or nails, but embodiments of fastening means are not limited to nails or screws. Other fastening means may use magnets, glue, or, for example, Velcro. In FIG. 1 it is not shown that inside the holder 110 a carrier with solid state light emitters is present. In the configuration shown in FIG. 1 the carrier is held by the holder and the carrier may have a good contact with the mounting surface 152 such that heat may be transported from the carrier towards the another object 150. The mounting surface 152 may be a surface which provides a thermal conductive interface towards a heat sink being present in the another object 150. The another object 150 may be of metal and may act accordingly as a heat sink.

Figure 2:
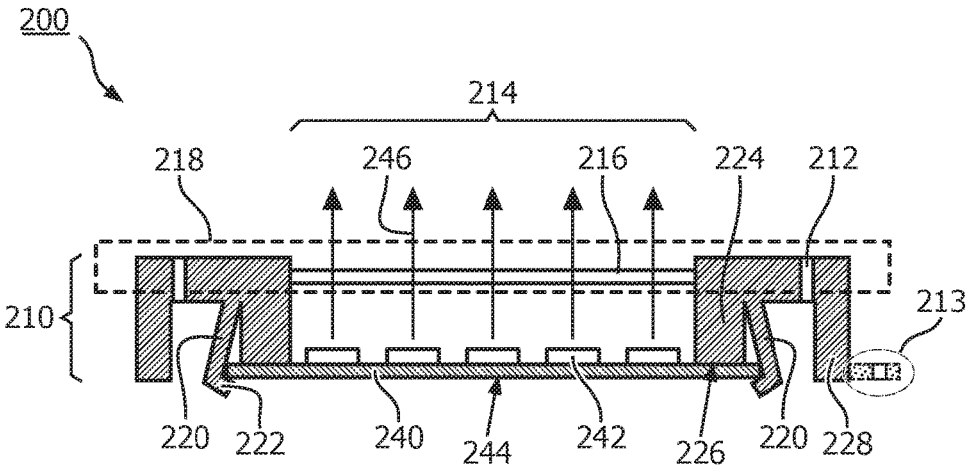

FIG. 2 schematically shows in a cross-sectional view a holder 210 with a carrier 240 in which hooks 220 of the holder 210 are in a clamping position.

The carrier 240 may be a printed circuit board or a solid substrate of a specific material on which one or more solid state light emitters 242 are provided. The solid state light emitters 242 are, for example, Light Emitting Diodes, Organic Light Emitting Diodes, or laser diodes. The carrier comprises a first side on which the solid state light emitters 242 are provided, and comprises a second side 244 which is opposite the first side. When the carrier 240 is a printed circuit board, electrically conductive paths are provided in the interior of the printed circuit board. When the carrier 240 is a substrate of another material, electrical wires may be provided on the first side of the carrier 240, or they may also be integrated into the interior of the carrier 240. In operation the solid state light emitters 242 emit light 246. When the carrier 240 with solid state light emitters 242 is assembled to the holder 210, the light 246 is transmitted through a light exit window 214 of the holder 210 into an ambient of the holder 210. It is to be noted that the light exit window 214 of the holder 210 may also comprise an optical element 216. The optical element 216 may be a diffuser, or a lens, or a transparent solid layer. Other optical element may also be provided in between the solid state light emitters 242 and the light exit window 214, such as one or more reflectors. The optical element 216 is drawn as a flat shaped element, but may also have a curved shape, such as a dome shaped diffuser.

The holder 210 comprises a front panel 218 which is a (virtual) panel of the holder 210 which comprises the light exit window 214. In particular, the term "virtual" is used because the light exit window 214 may comprise an optical element or may not comprise any specific other element or layer. When the holder 210 is fastened to another object, the front panel 218 is a panel of the holder 210 which is furthest away from the another object. The presented holder of FIG. 2 comprises in the front panel 218 also fastening elements 212 which are formed by a hole in the front panel 218. Seen from the front panel 218, a space behind the fastening elements 212 is empty such that a nail or a screw can be inserted into the fastening element 212 to fasten the holder 210 to a mounting surface of another object. Alternative fastening elements 213 may be provided in addition to or instead of the fastening element 212. The alternative fastening elements 213 are protruding elements that protrude from the holder 210 in a lateral direction and which comprise a hole for receiving a nail or a screw.

The holder 210 comprises a contact surface 226. The contact surface 226 may be a surface of a contact protrusion 224 that faces away from the front panel 218. The contact surface 226 may also be formed by surfaces of a plurality of contact protrusions 224. The contact protrusions 224 are coupled to the front panel 218 and protrude towards a position where the carrier 240 may be received by the holder. The contact surface 226 provides a stop position with which the carrier 240 is in contact when the carrier 240 is assembled in the holder and, when the holder 210 is fastened to the mounting surface of another object, the carrier 240 is provided in between the mounting surface and contact surface 226. In an embodiment, when the holder 210 is fastened to the mounting surface of another object, the carrier 240 is clamped in between the mounting surface and contact surface 226.

The holder 210 comprises at least two hooks 220. In FIG. 2 two hooks are drawn, but more than two hooks 220 may be provided as well. The hooks 220 are, in a cross-sectional view, arm shaped. The hooks 220 are coupled at a base end of the arms to the front panel 218 of the holder 210 and at a free end of the arms (which is an end that is opposite the base end) the hooks 220 may comprise a clip 222.

In FIG. 2 the hooks 220 are in their clamping position. When the hooks are in the clamping position, the carrier 240 is clamped in between the hooks 220 and the contact surface 226. More in particular, when the hooks 220 comprise the clips 222, the carrier 240 is clamped in between a surface of the clips 222 and the contact surface 226.

The hooks 220 are moveable to a sidewards position. In this sidewards position the hooks are at a location which is sidewards of the carrier 240. More in particular, the hooks are moved towards the sidewards position when the holder is fastened to the mounting surface of another object. This is schematically presented in FIG. 3.

The holder 210 together with the carrier 240 with solid state light emitters 242 forms a lighting module 200.

Figure 3:
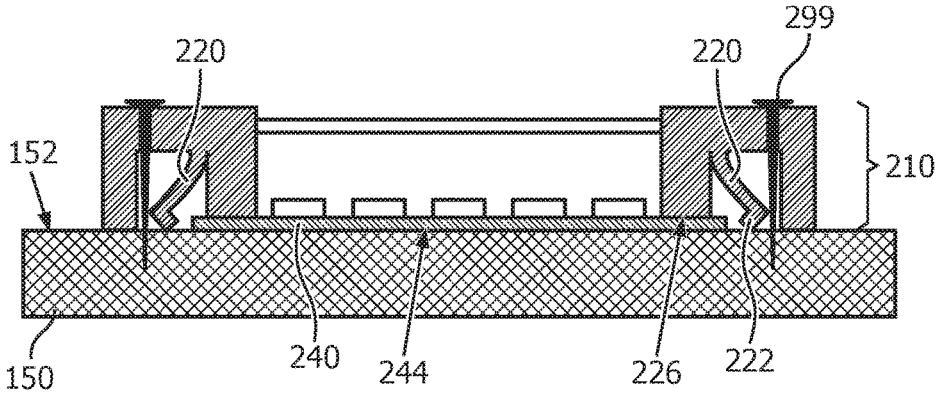

FIG. 3 schematically shows in a cross-sectional view the holder 210 with the carrier 240 that is assembled to a mounting surface 152 of another object 150 and in which the hooks 200 of the holder 210 are in the sidewards position. In the presented figured, the holder 210 is fastened with nails 299 to the another object. Alternatively screws may be used. Also other fastening means may be used. The second side 244 of the carrier 240 is in contact with the mounting surface 152 of the another object 150 such that, for example, heat can be transferred from the carrier 240 to the another object 150. In this configuration the carrier 240 is in between the contact surface 226 and the mounting surface 152. As shows, the hooks 220 are moved towards another position such that the clips 222 are not in between the second side 244 of the carrier 240 and the mounting surface 152.

Figure 4:
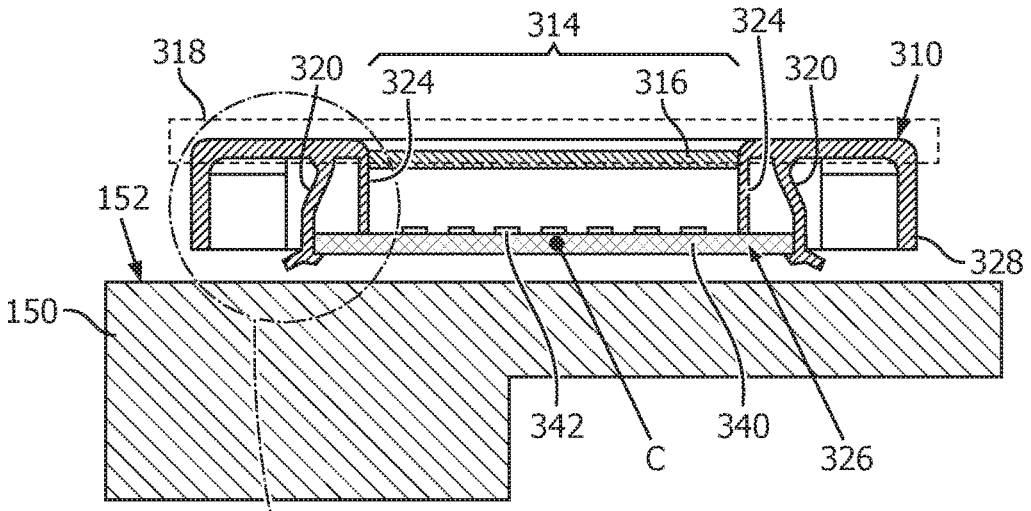

FIG. 4 schematically shows a cross-sectional view of another embodiment of a holder 310 that is holding a printed circuit board 340. The printed circuit board 340 comprises a plurality of Light Emitting Diodes (LEDs). In operation the LEDs emit light and when the printed circuit board 340 is held by the holder 310, the emitted light is transmitted via a diffusing element 316 and via the light exit window 316 into an ambient of the holder 310. The (virtual) front panel of the holder 310 is indicated with reference number 318. The holder 310 also comprises an outer wall 328 which is arranged substantially perpendicular to the front panel 318. The front panel 318 and the outer wall 328 enclose a cavity. Within the cavity are provided hooks 320 and contact protrusions 324 and when the printed circuit board 340 is held by the holder 310, the printed circuit board 340 is also arranged within the cavity. When a cross-sectional view is obtained from the holder 310 in a plane that is substantially parallel to the front panel 318, the outer wall 328 of the holder 310 has a substantially circular shape. Other cross-sectional shapes are also possible, like a rectangular, square or elliptical shape.

In FIG. 4 the hooks 320 are in their clamping position which means that they are arranged in this position to clamp the printed circuit board in between the contact surface 326 and the hooks 320.

In FIG. 4 a center C of the printed circuit board 340 is indicated.

Figure 5:
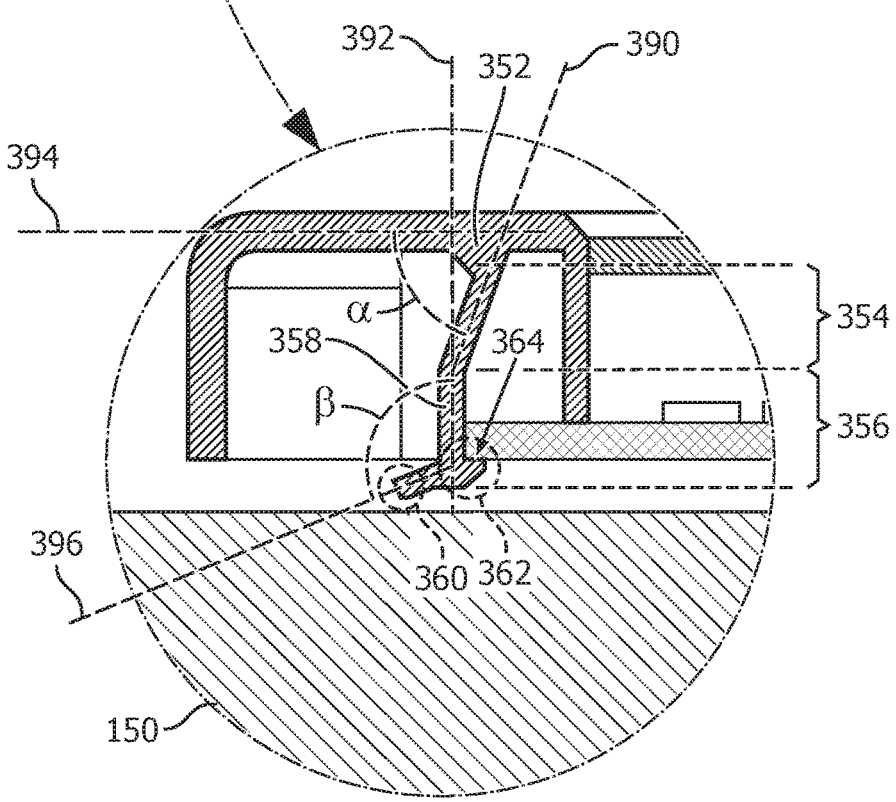

FIG. 5 schematically shows a detail of the cross-sectional view of FIG. 4 wherein the presented hook is in the clamping position. FIG. 5 only shows an embodiment of a single hook, but as seen in FIG. 4 the other hook has a similar mirrored shape. As shown in FIG. 5, the hook comprises a base end 352 where it is coupled to the front panel. Opposite the base end 352 of the hook, the hook comprises a free end 358. A relatively large portion of the hook is, in a cross-sectional view, arm-shaped and the arm shaped portion of the hook is subdivided into a first portion 354 and a second portion 356. The first portion 354 contacts the base end 352 of the hook and the second portion 356 contact the free end 358 of the hook. At the free 358 end of the hook is provided a clip 362 which is arranged, when the hook is in the clamping position, into a direction of the center of the printed circuit board (see FIG. 4). The clip 362 has a clipping surface 364 which contacts a surface of the printed circuit board for clamping the printed circuit board in between the clips and the contact surface. The clipping surface 364 is oriented substantially perpendicular to the second portion 356 of the hook.

The hook also comprises, at its free end 358, an anchor bar 360. The anchor bar 360 extends away from the free end 358 in a direction away from the clip 362. When the holder 310 is brought in contact with the mounting surface of the another object 150, the anchor bar receives a force from the another object 150. This force increases when the holder is pressed against the another object 150. The anchor bar has a specific shape which uses the force to move the arm from the clamping position at least for some distance towards the sidewards position. It might be that during this movement from the clamping position towards the sidewards position the clip 362 receives also a force to complete the move towards the sidewards position.

In FIG. 5 several lines are drawn, which are: line 394 following the direction of the front panel, line 390 which follows a direction of the first portion 354 of the hook, line 392 which follows a direction of the second portion 356 of the hook and a line 396 which follows a direction of the anchor bar 360. When the hook is in the clamping position, the second portion 356 has an orientation substantially perpendicular to the front panel, which means that an angle between line 392 and line 394 is about 90 degrees. When the hook is in the clamping position, an angle $\alpha$ between line 390 and line 394 is in a range from 45 to 80 degrees, or, in another embodiment, in a range from 55 to 75 degrees, or has a value of about 67 degrees. The angle $\alpha$ is the smallest angle formed between the lines 390, 394. When the hook is in the clamping position, an angle $\beta$ between line 392 and line 396 is in a range from 95 to 120 degrees, or, in another embodiment, in a range from 100 to 115 degrees, or has a value of about 110 degrees. The angle $\beta$ is the largest angle formed between the lines 390, 394.

Figure 6:
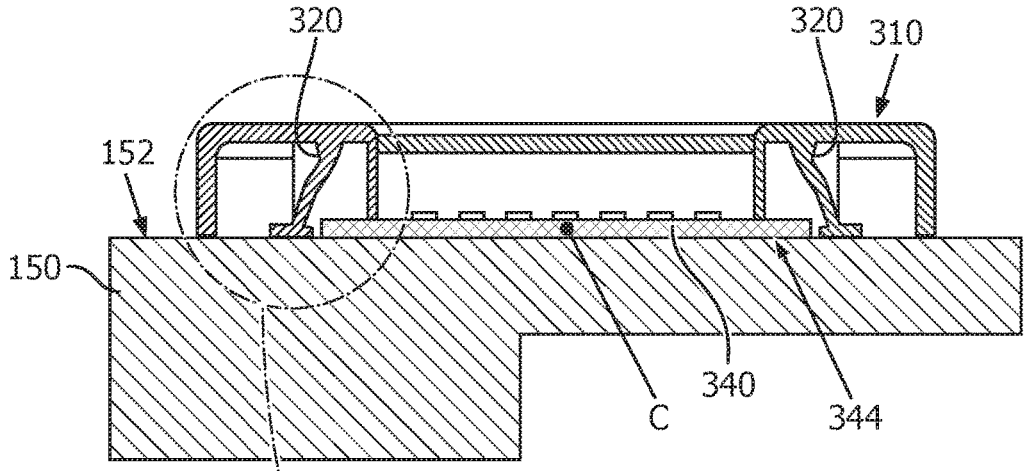

FIG. 6 schematically shows a cross-sectional view of the another embodiment of the holder 310 when the holder 310 is being fastened to another object 150. FIG. 6 does not show how the holder 310 is exactly fastened to the another object 150. This may be done with fastening elements and fastening means that are discussed previously. In FIG. 6 the hooks 320 are in the sidewards position, which is a position away from the center C of the printed circuit board 340. In the sidewards position no parts or portions of the hooks 320 are in between the second side 344 of the printed circuit board 340 and the mounting surface 152 of the another object 150. As discussed previously, when the holder 310 was pushed to the mounting surface 152, the anchor bars of the hooks 320 received a force which initiates the move of the hooks 320 towards the sidewards position. The hooks 320 are made of a material that is slightly resilient, which means that the movement of the hooks 320 from the clamping position towards the sidewards position is allowed by the material such that the material does not break. In another embodiment, when the holder 320 is manufactured and no printed circuit board 340 is assembled in the holder, the hooks 320 are in the clamping position and the resilient character of the material of the hooks 320 allow them to flex towards the sidewards position when a force is received. When the hooks 320 are in the sidewards position and do not anymore the force, the hooks 320 flex back towards the clamping position.

Figure 7:
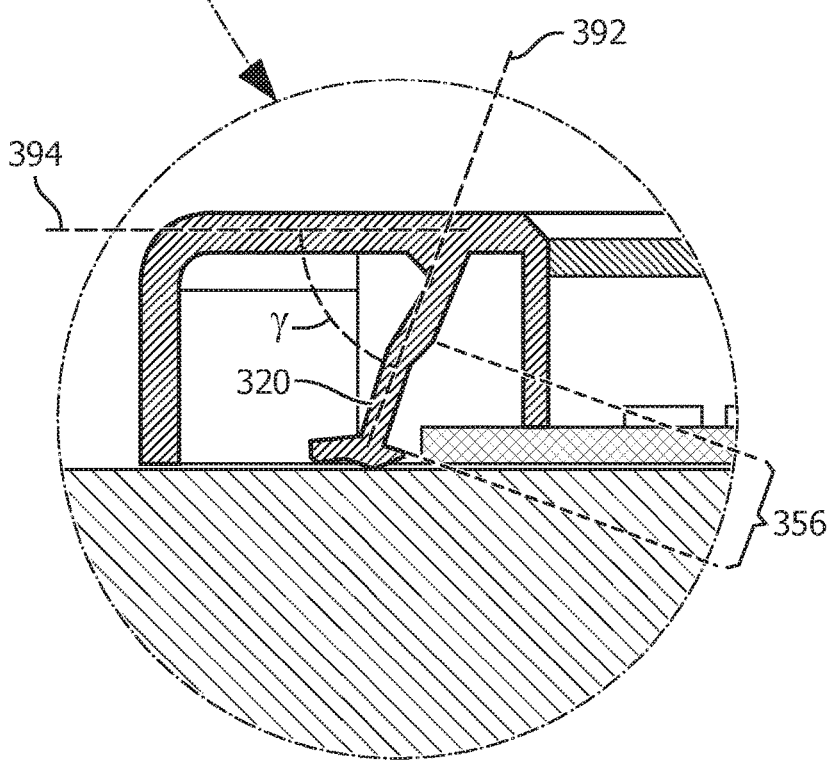

FIG. 7 schematically shows a detail of the cross-sectional view of FIG. 6 wherein the presented hook 320 is in the sidewards position. As seen in FIG. 7, when the hook 320 is in the sidewards position, line 392 is not anymore oriented perpendicular to line 394, but an angle $\gamma$ between the lines has a value in a range from 60 to 85 degrees, or, in an embodiment, from 70 to 80 degrees, or has the value of 75 degrees.

Figure 8:
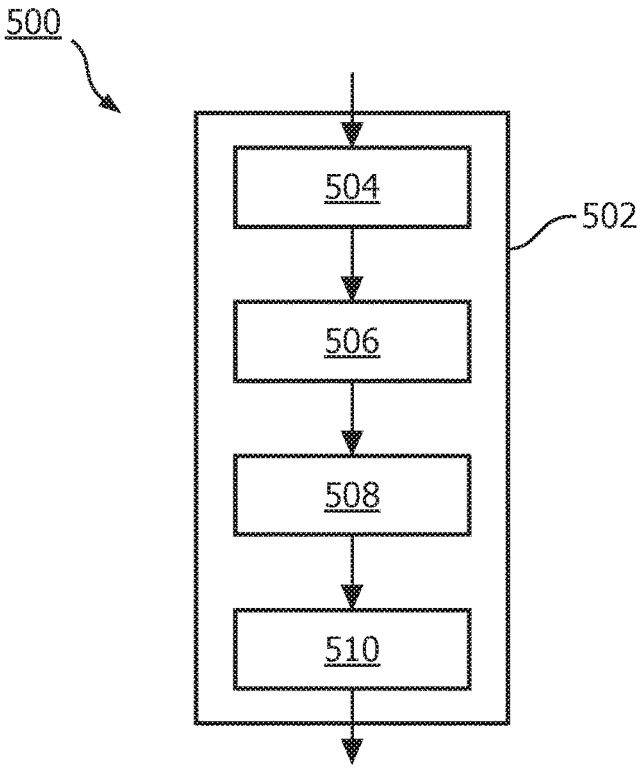

FIG. 8 schematically shows an embodiment of a method 500 of manufacturing a holder for a lighting module. The holder is for holding a carrier comprising solid state light emitters. The method 500 comprises the step of forming 502 a holder from a synthetic material. The step of forming 502 the holder at least comprises: a) forming 504 a light exit window for allowing the transmission of light into an ambient of the holder, the light being emitted, in use, by the solid state light emitters provided on the carrier, b) forming 506 a fastening element for receiving a fastening means for fastening the holder to a mounting surface of another object, c) providing 508 a contact surface for providing a stop position with which the carrier is in contact when the carrier is assembled in the holder and for holding the carrier between the contact surface and the mounting surface of the another object when the holder is fastened to the mounting surface of the another object, d) forming 510 at least two hooks being arranged for clamping the carrier to the contact surface when the holder is assembled to the carrier and being arranged for moving away from the carrier when the holder comprising the carrier is fastened to the mounting surface of the another object.

Figure 9:
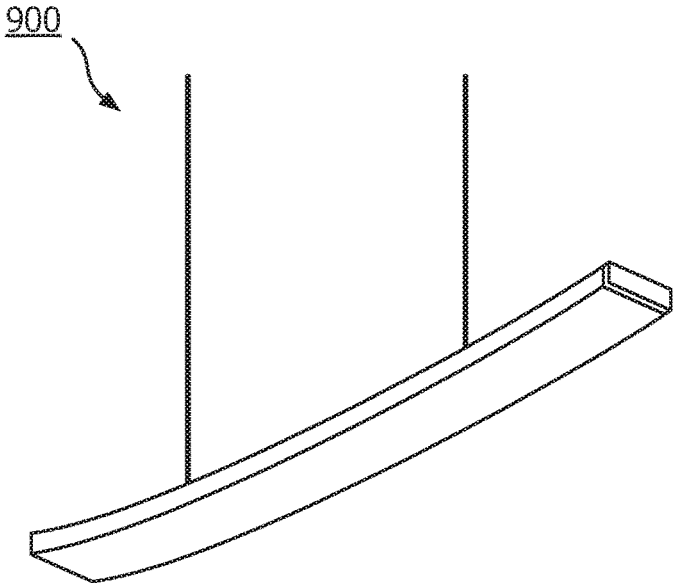

FIG. 9 schematically shows a luminaire 900. The luminaire 900 comprises a holder (not shown) according to one of the previously discussed embodiments or comprises a lighting module (not shown) as discussed above.

In summary, a holder for holding a carrier comprising solid state light emitters, a lighting module, a luminaire and a method of manufacturing a holder for a lighting module are provided. The holder comprises a light exit window, a fastening element, a contact surface and at least two hooks. The contact surface provides a stop position with which the carrier is in contact when the carrier is assembled in the holder. The at least two hooks are moveable between a clamping position and a sidewards position. When the holder is assembled to the carrier, i) and when said hooks are in the clamping position, said hooks are arranged for clamping the carrier between said hooks and the contact surface, and ii) when the holder is fastened to the mounting surface of the another object, said hooks are in the sidewards position, the sidewards positions is a position away from the carrier.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A holder for holding a carrier comprising solid state light emitters, the holder comprising:

a light exit window for allowing a transmission of light from the solid state light emitters into an environment of the holder, a fastening element for receiving a fastener to fasten the holder to a mounting surface of an object a contact surface for providing a stop position with which the carrier contacts when the carrier is assembled in the holder and wherein the contact surface forces the carrier against the mounting surface of the object when the holder is fastened to the mounting surface of the object, and at least two hooks extending from the holder which are moveable between a clamping position and a sidewards position, wherein, when the holder is assembled to the carrier, said hooks are in the clamping position, and said hooks are arranged for clamping the carrier between said hooks and the contact surface, and when the holder is fastened to the mounting surface of the object, said hooks are arranged to be in the sidewards position, the sidewards positions being a position away from the carrier, wherein said hooks are arranged to receive a force from the mounting surface of the object when the holder is pressed against the mounting surface for moving said hooks at least partially from the clamping position towards the sidewards position.

2. The holder according to claim 1, wherein the positions of the contact surface and of said hooks in the sidewards position are arranged for allowing a contact between the carrier and the mounting surface of the object.

3. The holder according to claim 1 comprising a front panel, the front panel comprising the light exit window, wherein said hooks comprise an arm which protrudes away from the front panel, said arms have a base end at a position where the arms are coupled to the front panel and have a free end opposite the base end, said hooks comprise a clip for engaging with a side of the carrier in the clamping position for clamping the carrier between said clips and the contact surface, said clips are arranged at the free end of said arms and extend from the free end substantially into a direction of a central point (C) of the carrier when the holder holds the carrier.

4. The holder according to claim 3, further comprising a contact protrusion which extends away from the front panel, a first end of the contact protrusions being opposite a second end of the contact protrusion, the first end comprising the contact surface, the second end of the contact protrusion is coupled to the front panel.

5. The holder according to claim 1, wherein said hooks comprise an anchor bar provided at the free end of said arms, the anchor bars extends away from the free end in a direction away from said clips, said anchor bars are arranged to at least partially receive the force from the mounting surface of the object when the holder is assembled to the carrier and when the holder is pressed to the mounting surface.

6. The holder according to claim 3, wherein said arms of said hooks are resilient for allowing a flexing from the clamping position to the sidewards position.

7. The holder according to claim 5, wherein said arms are subdivided into a first portion and a second portion, the first portion is at the base end of the arm and is coupled to the front panel, and, when said hooks are in the clamping position:

i) first angles ($\alpha$) between the front panel and said first portions are in the range from 45 degrees to 80 degrees, ii) said second portions are arranged substantially perpendicular to the front panel, and iii) second angles ($\beta$) between said anchor bars and the second portions to which said anchor bars are coupled are in the range from 95 degrees to 120 degrees.

8. The holder according to claim 7, wherein said clips of said arms have a clipping surface for contacting the carrier when the holder is assembled with the carrier and when the holder is not fastened to the mounting surface, the clipping surfaces of said clips are arranged substantially perpendicular to the second portions to which said clips are coupled to.

9. The holder according to claim 1, wherein an outer surface of the holder has a substantially circular cross-sectional shape seen in a plane that is substantially parallel to the light exit window.

10. A lighting module comprising the holder according to claim 1, and a carrier comprising solid state light emitters, wherein the holder holds the carrier.

11. The lighting module according to claim 10, wherein, when the lighting module is not fastened to a mounting surface of another object, the carrier is clamped between the contact surface and the at least two hooks of the holder.

12. A luminaire comprising the holder according to claim 1.

13. A method of manufacturing a holder for holding a carrier comprising solid state light emitters, the method comprises the step of forming a holder from a synthetic material, wherein the step of forming the holder at least comprises forming a light exit window for allowing a transmission of light from the solid state light emitters into an environment of the holder, forming a fastening element for receiving a fastener to fasten the holder to a mounting surface of an object, providing a contact surface for providing a stop position with which the carrier is in contact when the carrier is assembled in the holder and for holding the carrier between the contact surface and the mounting surface of the object when the holder is fastened to the mounting surface of the object, and forming at least two hooks being arranged for clamping the carrier to the contact surface when the holder is assembled to the carrier and being arranged for moving sidewards and away from the carrier when the holder comprising the carrier is fastened to the mounting surface of the object, wherein the at least two hooks are configured to receive a force from the mounting surface of the object when the holder is pressed against the mounting surface for moving said hooks sidewards and at least partially away from being clamped to the carrier.

14. A luminaire comprising a holder comprising the lighting module according to claim 10.

* * * * *